US008744326B2

(12) United States Patent
Suzuki

(10) Patent No.: US 8,744,326 B2
(45) Date of Patent: Jun. 3, 2014

(54) ELECTRO-CONDUCTIVE BELT, FABRICATION METHOD THEREOF, AND IMAGE FORMING DEVICE

(75) Inventor: Tomoko Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 670 days.

(21) Appl. No.: 12/627,478

(22) Filed: Nov. 30, 2009

(65) Prior Publication Data

US 2010/0239332 A1 Sep. 23, 2010

(30) Foreign Application Priority Data

Mar. 19, 2009 (JP) ..... 2009-068301
May 27, 2009 (JP) ..... 2009-127218

(51) Int. Cl.
*G03G 15/01* (2006.01)
*G03G 15/16* (2006.01)

(52) U.S. Cl.
CPC ..... *G03G 15/162* (2013.01); *G03G 2215/1623* (2013.01)
USPC ..... 399/302

(58) Field of Classification Search
CPC ..... G03G 15/162; G03G 2215/1623
USPC ..... 399/302, 297, 308, 310; 430/117.4
See application file for complete search history.

(56) References Cited

U.S. PATENT DOCUMENTS 5,923,936 A * 7/1999 Tanoue et al. ..... 399/297
6,647,237 B2 * 11/2003 Schlueter et al. ..... 399/307
6,810,228 B2 * 10/2004 Kiuchi et al. ..... 399/307
2002/0159801 A1 * 10/2002 Nakashima et al. ..... 399/307
2003/0175041 A1 * 9/2003 Taguchi et al. ..... 399/66
2004/0024107 A1 * 2/2004 Nojiri et al. ..... 524/495
2004/0218948 A1 * 11/2004 Miyakawa et al. ..... 399/302
2005/0249530 A1 * 11/2005 McLean et al. ..... 399/302
2007/0201897 A1 * 8/2007 Maeda et al. ..... 399/101
2008/0025771 A1 * 1/2008 Ogawa et al. ..... 399/330
2009/0148201 A1 * 6/2009 Sawai ..... 399/302
2010/0239764 A1 * 9/2010 Ichizawa et al. ..... 427/336
2010/0247171 A1 * 9/2010 Ono et al. ..... 399/302

FOREIGN PATENT DOCUMENTS

JP 07156287 A * 6/1995
JP A-07-156287 6/1995
JP A 10-226028 8/1998
JP A 11-109761 4/1999
JP A 2000-305377 11/2000
JP A-2001-022189 1/2001

(Continued)

OTHER PUBLICATIONS

Mar. 12, 2013 Office Action issued in Japanese Patent Application No. 2009-127218 (with English translation).

*Primary Examiner* — David Gray
*Assistant Examiner* — Tyler Hardman
(74) *Attorney, Agent, or Firm* — Oliff PLC

(57) ABSTRACT

There is provided an electro-conductive belt including a resin material and conductive particles, the electro-conductive belt including: an innermost layer that contains none of the conductive particles; a first conductive layer that is adjacent to the innermost layer at an outer side thereof, a concentration of the conductive particles being highest in the first conductive layer; and a second conductive layer that is adjacent to the first conductive layer at an outer side thereof, the second conductive layer containing the conductive particles in a concentration lower than in the first conductive layer and higher than in the innermost layer.

7 Claims, 3 Drawing Sheets

(56) References Cited

FOREIGN PATENT DOCUMENTS

| | | |
|---|---|---|
| JP | A-2001-129837 | 5/2001 |
| JP | A 2001-265135 | 9/2001 |
| JP | A 2002-12681 | 1/2002 |
| JP | A-2002-086465 | 3/2002 |
| JP | A-2002-086599 | 3/2002 |
| JP | A-2002-162836 | 6/2002 |
| JP | A 2004-29769 | 1/2004 |

* cited by examiner

ELECTRO-CONDUCTIVE BELT, FABRICATION METHOD THEREOF, AND IMAGE FORMING DEVICE

CROSS-REFERENCE TO RELATED APPLICATION

This application claims priority under 35 USC 119 from Japanese Patent Application No. 2009-068301 filed on Mar. 19, 2009 and Japanese Patent Application No. 2009-127218 filed on May 27, 2009.

BACKGROUND

1. Technical Field

The present invention relates to an electrically electro-conductive belt, a fabrication method thereof, and an image forming device.

2. Related Art

Among electro-photographic image forming devices, a mode is common in which a toner image formed on a photoconductor surface is transferred to an intermediate transfer belt, and is transferred to a recording medium such as recording paper or the like at a secondary transfer portion.

For an electro-conductive belt such as the intermediate transfer belt in this mode of image forming device, it is desired that resistance values of an inner peripheral face and an outer peripheral face are controlled such that a resistance value of the inner peripheral face is small but a volume resistance is large, so as to prevent white spots, at which the toner transferred to the intermediate transfer belt detaches in the form of white spots, and suchlike.

As technologies for controlling to make the inner peripheral face resistance value of an electro-conductive belt small and the volume resistance large, there are, for example:

(1) An endless belt formed by centrifugal molding and including two layers: a front face layer formed of a thermosetting polyimide resin layer that is obtained by ring closure imidization of a polyimide precursor containing a conductive material; and a rear face layer formed of a thermosetting polyimide resin layer obtained by ring closure imidization of a polyimide precursor containing a conductive material. Both the front face layer and the rear face layer are obtained at the same time by ring closure imidization. The surface electrical resistance of the front face layer is $10^9$ Ω/square to $10^{13}$ Ω/square and is larger than the surface electrical resistance of the rear face layer, and the volume electrical resistance of the endless belt has a value smaller than the surface electrical resistance of the front face layer;

(2) An endless tubular semi-conductive polyamideimide film belt in a condition in which, in a single layer, the electrical resistance of a rear face portion is smaller than that of a front face portion;

(3) A seamless belt with a base material consisting of a single layer that has different properties at a front face and a rear face due to an uneven distribution of an additive in the thickness direction;

(4) An electro-conductive belt at which the surface resistance of the inner peripheral face is lowered by a conductivity treatment being applied to the inner peripheral face side by spraying;

(5) A monolayer seamless belt formed of a polyimide resin containing a conductive filler of which conductive filler is uniformly distributed without bias in the thickness direction of the belt; and (6) An intermediate transfer belt that contains plural kinds of carbon which are dispersed in substrates and whose conductivities are different, and among the plural kinds of carbon with different electrical conductivities, the carbon with the lowest conductivity is distributed to a front face side of the belt.

SUMMARY

According to an aspect of the invention, there is provided an electro-conductive belt including a resin material and conductive particles, the electro-conductive belt including: an innermost layer that contains none of the conductive particles; a first conductive layer that is adjacent to the innermost layer at an outer side thereof, a concentration of the conductive particles being highest in the first conductive layer; and a second conductive layer that is adjacent to the first conductive layer at an outer side thereof, the second conductive layer containing the conductive particles in a concentration lower than in the first conductive layer and higher than in the innermost layer.

BRIEF DESCRIPTION OF THE DRAWINGS

Exemplary embodiments of the present invention will be described in detail based on the following figures, wherein.

DETAILED EXPLANATION

1. First Exemplary Embodiment

Hereinafter, a full-color imaging device, which is an example of an image forming device of the present convention, will be described.

1-1. Overall Structure

Figure 1:
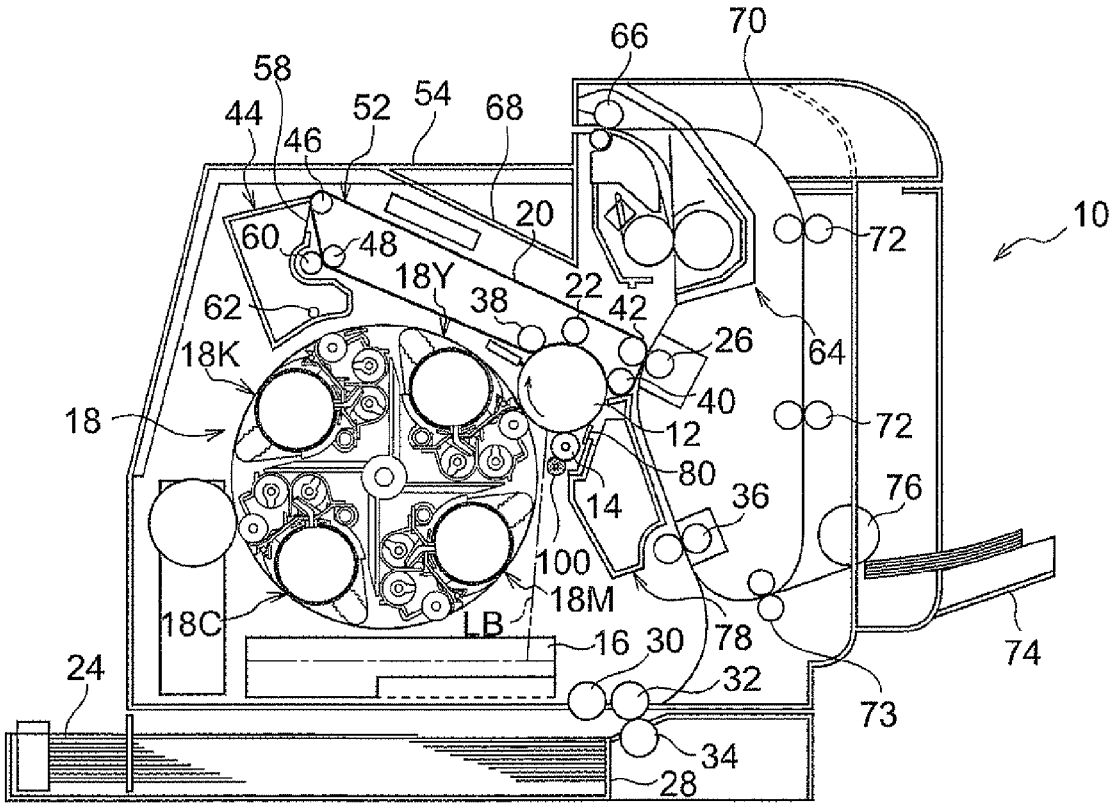
FIG. 1 is a schematic diagram illustrating structure of an example of an electro-photography-type image forming device in which the electro-conductive belt of the present invention is employed as an intermediate transfer belt.

An image forming device 10 relating to the first exemplary embodiment is a four-cycle-type full-color image forming device. As illustrated in FIG. 1, a photoconductor drum 12, which corresponds to an image-bearing body of the present invention, is rotatably disposed slightly upward and to the right of the middle of the interior of the image forming device 10. For example, a conductive cylinder with a diameter of approximately 47 mm whose surface is covered with a photosensitive layer formed of OPC or the like is used as the photoconductor drum 12. The photoconductor drum 12 is driven to rotate at a process speed of about 150 mm/s in the direction of the arrow by an unillustrated motor.

The surface of the photoconductor drum 12 is charged up to a predetermined potential by a charging roller 14, which is disposed substantially directly below the photoconductor drum 12. Then, image exposure is implemented by a laser beam LB from an exposure device 16, which is disposed below the charging roller 14, and an electrostatic latent image is formed in accordance with image information. The charging roller 14 corresponds to a charging member of the present invention.

The electrostatic latent image formed on the photoconductor drum 12 is developed by a rotary-type developing apparatus 18, in which developers 18Y, 18M, 18C and 18K for the colors yellow (Y), magenta (M), cyan (C) and black (K) are arranged along a circumferential direction, and a toner image of a predetermined color is formed.

Here, the steps of charging, exposure and development are repeated a predetermined number of times at the surface of the photoconductor drum 12, in accordance with the colors of an image to be formed. For the development step, the developing apparatus 18 turns and the developer 18Y, 18M, 18C or 18K of the corresponding color moves to a developing position opposing the photoconductor drum 12.

For example, if a full-color image is to be formed, the steps of charging, exposure and development at the surface of the photoconductor drum 12 are repeated four times, corresponding to the colors yellow (Y), magenta (M), cyan (C) and black (K), and toner images corresponding to the colors yellow (Y), magenta (M), cyan (C) and black (K) are successively formed at the surface of the photoconductor drum 12. A number of rotations of the photoconductor drum 12 in forming the toner images depends on the size of the image. However, if the image is, for example, A4 size, a single image is formed by the photoconductor drum 12 turning through three rotations. That is, toner images corresponding to the colors yellow (Y), magenta (M), cyan (C) and black (K) are formed while the photoconductor drum 12 turns through three rotations for each.

At a primary transfer position, at which an intermediate transfer belt 20 is wound round the outer periphery of the photoconductor drum 12, the toner images of the colors yellow (Y), magenta (M), cyan (C) and black (K) that have been successively formed on the photoconductor drum 12 are transferred, into a state of being superposed with one another, onto the intermediate transfer belt 20 by a primary transfer roller 22. The intermediate transfer belt 20 is an example of a transfer body.

The toner images of the colors yellow (Y), magenta (M), cyan (C) and black (K) that have been superposedly transferred onto the intermediate transfer belt 20 are together transferred onto a recording paper 24, which is supplied with a predetermined timing, by a secondary transfer roller 26.

Meanwhile, the recording paper 24 is fed out from a paper supply cassette 28, which is disposed at a lower portion of the image forming device 10, by a pickup roller 30. Being handled one sheet at a time, the recording paper 24 is supplied by a feed roller 32 and a retard roller 34, and being synchronized by registration rollers 36 with the toner images that have been transferred onto the intermediate transfer belt 20, the recording paper 24 is conveyed to the secondary transfer position. Herein, the intermediate transfer belt 20 is an example of the electro-electro-conductive belt of the present invention.

The intermediate transfer belt 20 extends, with a predetermined tension, between a wrap-in roller 38, the primary transfer roller 22, a wrap-out roller 40, a backup roller 42, a first cleaning backup roller 46 and a second cleaning backup roller 48. The wrap-in roller 38 defines a wrapping position of the intermediate transfer belt 20, at an upstream side thereof with respect to the direction of rotation of the photoconductor drum 12. The primary transfer roller 22 transfers the toner images formed on the photoconductor drum 12 onto the intermediate transfer belt 20. The wrap-out roller 40 defines the wrapping position of the intermediate transfer belt 20 at the downstream side of the wrapping position. The backup roller 42 abuts against the secondary transfer roller 26, through the intermediate transfer belt 20. The first cleaning backup roller 46 opposes a cleaning device 44 of the intermediate transfer belt 20. The intermediate transfer belt 20, for example, passively moves in accordance with rotation of the photoconductor drum 12, so as to circulate at a predetermined process speed (around 150 mm/s).

In this case, the intermediate transfer belt 20 is structured such that a cross-sectional shape in which the intermediate transfer belt 20 extends forms a flat, long, narrow substantial trapezoid, to enable a reduction in size of the image forming device 10.

The intermediate transfer belt 20 integrally structures an image formation unit 52 with the photoconductor drum 12, the charging roller 14, the intermediate transfer belt 20, the plural rollers 22, 38, 40, 42, 46 and 48 by which the intermediate transfer belt 20 is extended, the cleaning device 44 for cleaning the intermediate transfer belt 20, and a cleaning device 78 for cleaning the photoconductor drum 12, which will be described later. Hence, by an upper cover 54 of the image forming device 10 being opened and a handle (not shown) provided at an upper portion of the image formation unit 52 being manually lifted up, the whole image formation unit 52 may be removed from the image forming device 10.

The cleaning device 44 of the intermediate transfer belt 20 is provided with a scraper 58 and a cleaning brush 60. The scraper 58 is disposed so as to abut against the surface of the intermediate transfer belt 20 that is extended by the first cleaning backup roller 46. The cleaning brush 60 is disposed so as to press against the surface of the intermediate transfer belt 20 that is extended by the second cleaning backup roller 48. Residual toner, paper dust and the like that is removed by the scraper 58 and the cleaning brush 60 is recovered to the interior of the cleaning device 44.

The cleaning device 44 is disposed to be capable of swinging about a swinging axis 62, in the anticlockwise direction in the drawing. The cleaning device 44 is constituted so as to be withdrawn to a position that is distant from the surface of the intermediate transfer belt 20 until the secondary transfer of the toner image of a final color is complete, and to abut against the surface of the intermediate transfer belt 20 when the secondary transfer of the toner image of the final color has been completed.

The recording paper 24 to which a toner image has been transferred from the intermediate transfer belt 20 is conveyed to a fixing device 64. The toner image is heated and pressured by the fixing device 64 and fixed onto the recording paper 24. Thereafter, in a case of one-sided printing, the recording paper 24 to which the toner image has been fixed is ejected by an ejection roller 66 onto an ejection tray 68, which is provided at an upper portion of the image forming device 10, without further processing.

On the other hand, in a case of two-sided printing, the recording paper 24 on a first face (front face) of which a toner image has been fixed by the fixing device 64 is not ejected onto the ejection tray 68 by the ejection roller 66 without further processing; instead, a trailing end portion of the recording paper 24 is nipped by the ejection roller 66. In this state, the ejection roller 66 is turned in reverse, a conveyance path of the recording paper 24 is switched to a duplex paper conveyance path 70, and the recording paper 24 is inverted front-to-back by conveyance rollers 72 provided on the duplex paper conveyance path 70. In this state, the recording paper 24 is conveyed to the secondary transfer position of the intermediate transfer belt 20, and a toner image is transferred onto a second face (rear face) of the recording paper 24. Then, the toner image on the second face (rear face) of the recording paper 24 is fixed by the fixing device 64, and the recording paper 24 is ejected onto the ejection tray 68.

As a further option for the image forming device 10, a manual tray 74 may be retractably attached to a side face of the image forming device 10. The recording paper 24 that is placed on this manual tray 74, of arbitrary sizes and types, is supplied by a paper supply roller 76 and conveyed to the secondary transfer position of the intermediate transfer belt 20 via conveyance rollers 73 and the registration rollers 36. Thus, images may be formed on the recording paper 24 of arbitrary sizes and types.

After the process of transfer of the toner images has finished, residual toner, paper dust and the like is removed from the surface of the photoconductor drum 12 by a cleaning blade 80 of the cleaning device 78, which is disposed diagonally below the photoconductor drum 12, while the photoconductor drum 12 turns through one rotation, and then the photoconductor drum 12 is provided to the next process of image formation.

1-2. Structure of Intermediate Transfer Belt

Figure 2:
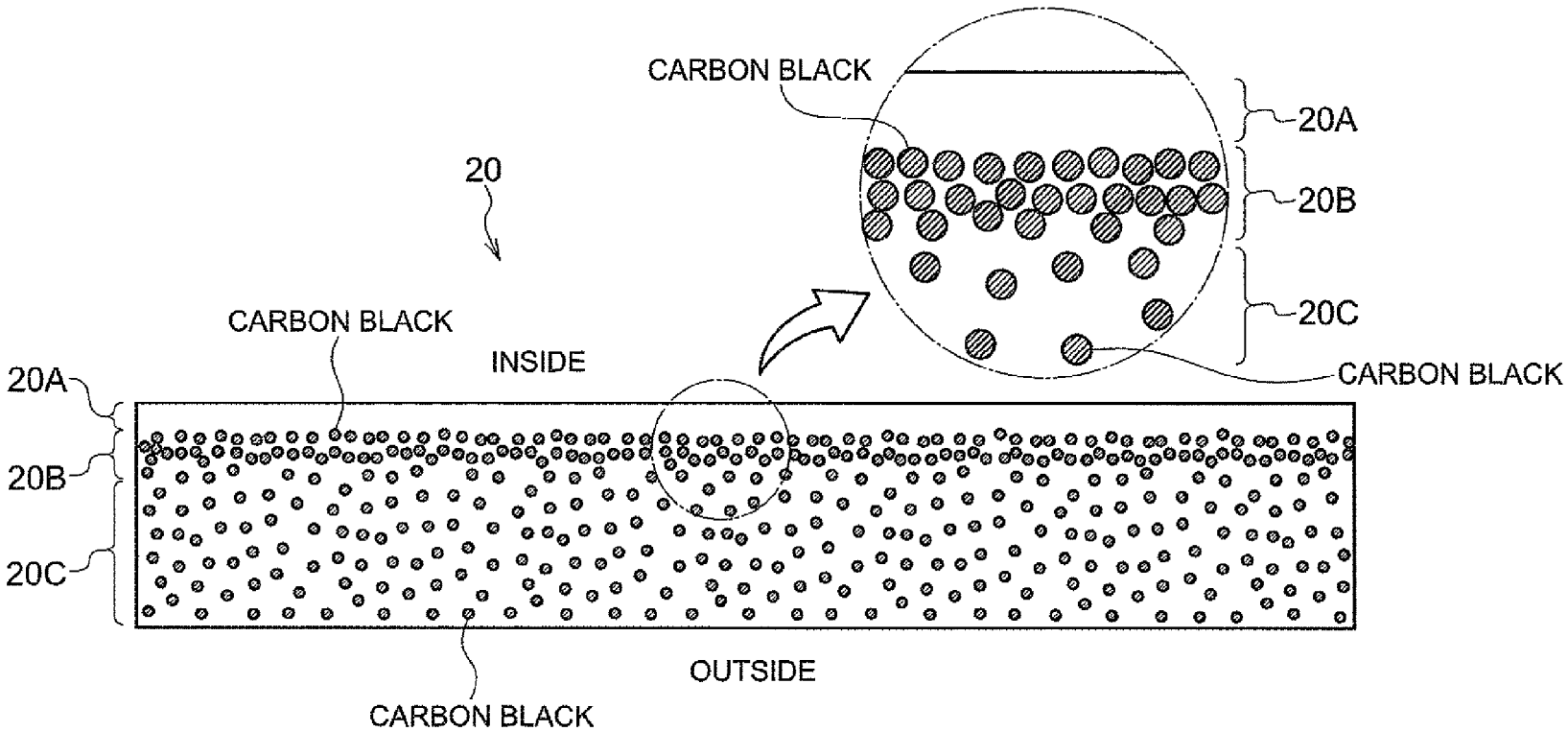
FIG. 2 is a schematic diagram illustrating a thickness direction cross-section of the intermediate transfer belt that is employed in the image forming device of FIG. 1.

The intermediate transfer belt 20 has a structure in which carbon black (CB) is embedded to serve as conductive particles in a polyimide resin endless belt. As illustrated in FIG. 2, an innermost layer 20A, a first conductive layer 20B and a second conductive layer 20C are formed in the intermediate transfer belt 20 in this order from the inside toward the outside. The innermost layer 20A contains almost no carbon black at all. The first conductive layer 20B has the highest concentration of carbon black and therefore the smallest electrical resistance. The second conductive layer 20C has a concentration of carbon black lower than that in the first conductive layer 20B and higher than that in the innermost layer 20A, and therefore has higher electrical resistance than the first conductive layer 20B and lower electrical resistance than the innermost layer 20A.

For the resin material that is used in the intermediate transfer belt 20, apart from various polyimide resins, any material may be used as long as it is a resin material that is used in electro-conductive belts, such as polyamideimide resins, polyurethane resins, fully aromatic polyester resins, polycarbonate resins, polyester resins, aromatic polyamide resins, polyether sulfone resins, polysulfone resins, polyether ethylketone resins, polysulfide resins and the like.

The conductive particles are not limited to the various kinds of carbon blacks. Depending on the levels of conductivity required for the endless belt, various metal powders and conductive oxide powders such as indium tin oxide (ITO), zirconium tin oxide (ZTO) and the like may be used.

An amount of carbon black contained in the intermediate transfer belt 20 may be suitably altered in accordance with a required range of conductivity. Ordinarily, an amount of carbon black of a range of 10 to 25% by weight of the intermediate transfer belt 20 is preferable.

The overall thickness of the intermediate transfer belt 20 may be specified in accordance with a tensile strength required for the intermediate transfer belt 20, and is ordinarily in a range from 50 to 200 μm.

The thickness of the innermost layer 20A, in regard to uniformity of the innermost layer 20A and electrical resistance of the inner peripheral face not being excessive, is preferably in a range from 0.5 to 2 μm, and particularly preferably from 1.0 to 2 μm.

The thickness of the first conductive layer 20B is preferably in a range from 5 to 15 μm, and particularly preferably in a range from 10 to 15 μm.

The intermediate transfer belt 20 may be fabricated by the following method.

Firstly, polyamic acid, which is a precursor of polyimide resin, is dissolved in a suitable solvent such as NMP (N-methyl-2-pyrrolidone) or the like, a predetermined amount of carbon black is mixed in, and a dispersion is prepared.

Next, the prepared dispersion is applied to the inside of a circular tube (a centrifugal molding die), and then the centrifugal molding die is rotated about its axis and centrifugal molding is carried out, while a drying process is carried out in which the dispersion is dried by heating. The drying process is carried out until a residual amount of solvent in a dry film formed at the inner peripheral face of the centrifugal molding die is in a range of 5 to 40% by weight of the whole dry film.

For measurement of the residual amount of solvent, the total weight of the coated film before drying is accurately measured and the total weight of the film and the weight of the contained solvent are calculated. Thereafter, the total weight of the film after the drying process is accurately weighed, the reduction is treated as a lost weight of solvent, and the lost solvent weight is subtracted from the solvent weight calculated before drying to find the remaining weight of solvent. Accordingly, (pre-drying film weight−post-drying film weight)/(pre-drying coating weight−resin solids weight−conductive particle weight) is calculated to obtain the remaining solvent amount.

When the remaining solvent amount in the dry film reaches the range of 5 to 40% by weight of the whole dry film, the drying process is temporarily stopped and a resin material leaching process is carried out, in which NMP is applied to the surface of the dry film.

In the resin material leaching process, polyamic acid is leached onto the inner peripheral face of the dry film, and carbon black migrates toward the outer side of the dry film. Thus, the innermost layer 20A containing hardly any carbon black is formed. In addition, the carbon black migrating toward the outer side of the dry film forms a region in which the concentration of carbon black is high, that is, the first conductive layer 20B, at the outer side of the innermost layer 20A. A region of the dry film at the outer side relative to the first conductive layer 20B is kept in the state as of the end of the drying process, which is to say a state in which the concentration of carbon black is lower than in the first conductive layer 20B. Thus, the second conductive layer 20C is formed.

Preferable liquids that may be applied to the dry film in the resin material leaching process are, apart from a solvent such as NMP used in preparation of the dispersion, liquids that have affinity with polyamic acid, which is to say liquids that are close in degree of polarity to polyamic acid, which is to further say liquids that are close in solubility constant to polyamic acid. However, liquids that may cause the polyamic acid to decompose, such as water, organic acids and amines, are not preferable.

When the innermost layer, the first conductive layer and the second conductive layer have been formed by the resin material leaching process, the dry film is removed from the centrifugal molding die and, in a heating process, the dry film is heated under predetermined temperature conditions and the polyamic acid is subjected to imidization. Herein, if a resin solution is soluble in a certain kind of solvent, such as a polyamideimide resin, a polyurethane resin, a fully aromatic polyester resin, a polycarbonate resin, a polyester resin, an aromatic polyamide resin, a polyether sulfone resin or a polysulfone resin, the resin material may be dissolved in this solvent to prepare a dope, and the dry film may be formed using a dispersion in which the conductive particles such as carbon black or the like are dispersed in the dope. In such a case, the resin material is barely changed at all in the heating process; in the heating process the drying of the dry film simply progresses further after the resin material leaching process.

When the solvent has been removed in the heating process, the dry film is cut to a predetermined dimension as necessary, and the electro-conductive belt is formed.

1-3. Effects of First Exemplary Embodiment

In the monolayer-type intermediate transfer belt 20 that contains conductive particles such as carbon black or the like in a resin material such as polyimide or the like, the electrical resistance changes easily in accordance with the strength of an electric field. For example, in the image forming device 10, when the type of recording paper 24 being used, the surrounding environment, a usage mode or the like changes and a discharge occurs between the photoconductor drum 12 and the intermediate transfer belt 20, an excessive voltage is applied to the intermediate transfer belt 20 for a moment. Therefore, the resistance of the intermediate transfer belt 20 is greatly reduced and a large current flows into the intermediate transfer belt 20. As a result, the potential of toner transferred to the intermediate transfer belt 20 is reversed, the toner falls from the surface of the intermediate transfer belt 20, and a white spot is formed. However, if the volume resistance over the whole thickness direction of the intermediate transfer belt 20 is large, then excessive voltages do not act on the intermediate transfer belt 20, even when the type of recording paper 24, the surrounding environment, the usage mode or the like changes.

However, when the volume resistance of the intermediate transfer belt 20 is large, discharges occur between the backup roller 42 and the inner peripheral face of the intermediate transfer belt 20 at the secondary transfer position between the secondary transfer roller 26 and the backup roller 42, and flake-form image defects are formed in the toner image transferred to the recording medium.

In order to prevent occurrences of these flake-form image defects, it is preferable to reduce the electrical resistance of the inner peripheral face while keeping the volume resistance over the whole thickness direction of the intermediate transfer belt 20 large.

As ways of achieving this, technologies in which multiple layers are arranged in an intermediate transfer belt have been considered. Because irregularities arise in halftone images when the thickness of a single layer is 10 μm or above, it is necessary for individual layers to have thicknesses of a few microns. However, in film formation by coating, it is difficult to form films of a few microns without deviation in film thickness. Techniques for making conductivity within a belt layer non-uniform have also been considered, however, employment of several kinds of conductive particles is required. In either case, an intermediate transfer belt having the constitution described in the first exemplary embodiment may not be obtained.

In the intermediate transfer belt 20 relating to the first exemplary embodiment, the innermost layer 20A that is a thin layer containing hardly any carbon black is formed at the innermost side, the first conductive layer 20B with a high concentration of carbon black is formed directly to the outside thereof, and the second conductive layer 20C with a larger electrical resistance than the first conductive layer 20B is formed directly to the outside of the first conductive layer 20B. Therefore, the intermediate transfer belt 20 as a whole may provide a large volume resistance and the electrical resistance of the inner peripheral face may be made small. Moreover, because the innermost layer is formed, the first conductive layer 20B will not be exposed and worn even after contact with the backup roller 42 over long periods, the resistance of the inner peripheral face will not suddenly increase, and flake-form image defects will not occur.

The first exemplary embodiment has been described on the basis of a case in which the electro-conductive belt is employed as an intermediate transfer belt. However, apart from an intermediate transfer belt, the electro-conductive belt may be employed as a substrate for a photoconductor, a conveyance belt that conveys a recording medium, and so forth.

Furthermore, various functional layers may be provided at the surface of the electro-conductive belt, such as a resilient layer, a separation layer, or the like.

EXAMPLES

1. Example 1

(1) Fabrication of Electro-Conductive Belt 3,3',4,4'-biphenyltetracarboxylic dianhydride and 4,4'-diaminophenylether were reacted in NMP, and a polyamic acid solution with a solids concentration of 18% by weight after imidization was prepared.

80 parts by weight of carbon black (manufactured by DEGUSSA, product name: Special Black 4) was added to 100 parts by weight of the obtained polyamic acid solution. Using a jet mill disperser (manufactured by GEANUS, product name: Geanus PY, minimum cross-sectional area of impact portions 0.032 $mm^2$), the mixture was passed through a dispersion unit section five times at a pressure of 200 MPa, and dispersed and mixed to provide a dispersion (A).

The previous polyamic acid solution was added to the obtained dispersion (A) so as to make the concentration of carbon black therein 21.2% by weight. Stirring and mixing was performed using a planetary mixer (manufactured by Aicohsha Manufacturing Co., Ltd., product name: Aicoh Mixer), and a dispersion was prepared.

Next, a silicone-based separation agent (manufactured by Shin-Etsu Chemical Co., Ltd., trade name: KS700) was applied to the inner peripheral face of a centrifugal molding die, which was an aluminium tube with an inner diameter of 366 mm, a length of 600 mm and a thickness of 6 mm, and baking processing was carried out for one hour at 300° C.

After the baking processing, the dispersion was poured into the centrifugal molding die, the centrifugal molding die was rotated at 50 rpm about its axis, and a uniform coating film with a thickness of 0.625 mm was obtained. When the coating film was formed, the centrifugal molding die was retained such that the axis was horizontal and dried by heating for 30 minutes at 145° C., and a dry film was obtained. The remaining amount of solvent in the dry film was 20% by weight of the dry film. The amount of solvent remaining in the dry film was found by the following procedure. Firstly, the dispersion before pouring into the centrifugal molding die was weighed, the measured weight was treated as a weight of the applied film, and the weight of solvent in the applied film was calculated from the amount of NMP contained in the solvent. Then, the weight of the obtained dry film was measured, and the difference between the weight of the applied film before drying and the weight of the dry film was treated as a lost weight of solvent. The lost weight of solvent was subtracted from the solvent weight in the applied film to find the weight of the amount of solvent remaining in the dry film. Finally, a proportion of the obtained remaining solvent weight relative to the weight of the whole dry film was found, and this was treated as the remaining solvent amount.

Without removing the obtained dry film from the centrifugal molding die, NMP was poured in onto the dry film, and the die was rotated for five minutes at a speed of 15 rpm at the room temperature.

Thereafter, the dry film was removed from the centrifugal molding die and set in an imidization die, and heated for 30 minutes at 200° C., 30 minutes at 260° C., 30 minutes at 300° C. and 20 minutes at 320° C., to obtain a film of polyimide resin in which carbon black was dispersed. The obtained polyimide resin was cut to a width of 362 mm, and an electro-conductive belt with an outer diameter of 365 mm, a width of 362 mm and a thickness of 100 μm was obtained.

Figure 3:
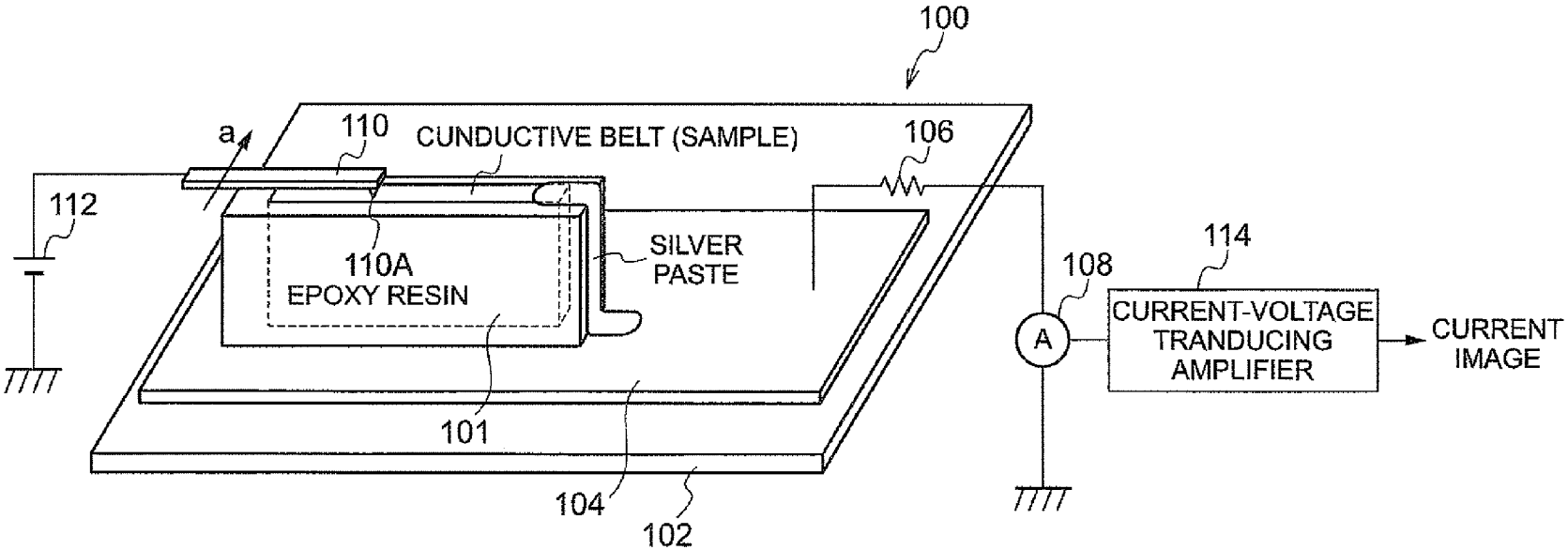
FIG. 3 is a schematic diagram illustrating structure of an apparatus that is used for measuring a distribution of conduction points in an intermediate transfer belt of an Example.

A sample which was a portion cut from the electro-conductive belt was embedded in epoxy resin to form a belt embedding block 101. A cut face of this belt embedding block 101 was exposed by a microtome and, using a measurement instrument 100 illustrated in FIG. 3, the distribution of carbon black was measured.

The measurement instrument 100 is provided with a print substrate 102, an ammeter 108, a probe 110, a DC power supply 112 and a current-voltage transducing amplifier 114. A copper film 104, on which the belt embedding block 101 is placed, is adhered to the print substrate 102. The ammeter 108 is connected with the copper film 104 of the print substrate 102 via a short-circuit prevention resistance 106 (around 1 kΩ). The probe 110 includes a contact point 110A that abuts against the end face of the belt embedding block 101 that is at the side of the cut face exposed by the microtome, and scans along the thickness direction of the electro-conductive belt. The DC power supply 112 applies DC voltage to the probe 110. The current-voltage transducing amplifier 114 converts currents read by the ammeter 108 to voltages and amplifies the same. The negative side of the DC power supply 112 and the earth side terminal of the ammeter 108 are both connected to earth. During measurement, the cut face at the side of the belt embedding block 101 opposite to the side at which the cut face was exposed was placed on the copper film 104, and the cut face at the side of the exposed cut face was scanned in the thickness direction of the electro-conductive belt by the probe 110 to obtain a current image. In the obtained current image, there was a region in which no current flowed at the innermost side, a region in which current flowed at the immediate outside thereof had the highest current density distribution, and a region in which current flowed further to the outside had a lower current density distribution. Herein, the regions in which current flowed in the electro-conductive belt were simply considered to be regions in which carbon black was dispersed. Therefore, it is seen that in the obtained electro-conductive belt, the following layers were formed as illustrated in FIG. 2: an innermost layer that does not contain carbon black; a first conductive layer disposed immediately to the outside with the highest concentration of carbon black; and a second conductive layer disposed further to the outside in which the concentration of carbon black is lower than in the first conductive layer. In the sample cut from a portion of the electro-conductive belt, the thickness of the innermost layer was 1.2 μm and the thickness of the first conductive layer was 11 μm.

(2) Fabrication and Evaluation of Intermediate Transfer Belt

Next, two of the electro-conductive belt were connected with each other so that the innermost layer disposed at the inside to form an intermediate transfer belt 1 having a peripheral length of 2111 mm. Surface resistivities of the outer peripheral face and the inner peripheral face (log Ω/square) and the volume resistivity (log Ω·cm) were measured. The results were as follows: the surface resistivity of the outer peripheral face was 13.8 log Ω/square, the surface resistivity of the inner peripheral face was 12.0 log Ω/square, and the volume resistivity was 12.4 log Ω·cm. The results show that the provided intermediate transfer belt 1 had a high electrical resistance at the outer peripheral face, and that an electrical resistance at the inner peripheral face was lower than that at the outer peripheral face.

Then, a full-color photocopier (manufactured by Fuji Xerox Co., Ltd., product name: DocuColor 8000 Digital Press) was restructured as an image evaluation apparatus by detaching the secondary transfer roller 26 from the main power supply and connecting the secondary transfer roller 26 to an external power supply (manufactured by TREK, INC., MODEL 610D). The intermediate transfer belt 1 was installed in this image evaluation apparatus, the voltage to be applied to the secondary transfer roller 26 was set to 4.0 kV, and two-sided printing was carried out on A3-sized paper. For the printed images a halftone pattern image (cyan 70%) was printed. The presence or absence of flake-form image defects and white spots in the obtained images was evaluated visually, and the evaluation was carried out for both sides of the paper. Evaluation grades of flake-form image defects and white spots were as shown below. For both flake-form image defects and white spots, G0 is the best grade and G6 is the worst.

<Flake-Form Image Defects>

G0: No occurrences observed

G1: A few occurrences observed (within a tolerable level)

G2: Occurrences observed (within a tolerable level)

G3: Occurrences easily observed (within a tolerable level)

G4: Occurrences easily observed (outside a tolerable level)

G5: Occurrences significant, well beyond a tolerable level

G6: Occurrences of obvious flake-form image defects may be observed

<White Spots>

G0: No occurrences observed

G1: A few occurrences observed (within a tolerable level)

G2: Occurrences observed (within a tolerable level)

G3: Occurrences easily observed (within a tolerable level)

G4: Occurrences easily observed (outside a tolerable level)

G5: Occurrences significant, well beyond a tolerable level

G6: Numbers of occurrences and sizes of white spots are large, clearly beyond a tolerable level The results are shown in Table 1.

TABLE 1

| | Carbon black (wt. parts) | Drying conditions | Solvent weight (wt %) | Solvent processing | Innermost layer thickness (μm) | First conductive layer thickness (μm) | Outer periphery surface resistance (logΩ/□) |
|---|---|---|---|---|---|---|---|
| Example 1: intermediate transfer belt 1 | 21.2 | 145° C., 30 min. | 20 | Yes | 1.2 | 11 | 13.8 |

TABLE 1-continued

| | | | | | | | |
|---|---|---|---|---|---|---|---|
| Example 2: intermediate transfer belt 2 | 21.2 | 145° C., 40 min. | 11 | Yes | 1.9 | 15 | 14.4 |
| Example 3: intermediate transfer belt 3 | 21.2 | 145° C., 15 min. | 40 | Yes | 0.5 | 5 | 14.8 |
| Example 4: intermediate transfer belt 4 | 21.2 | 145° C., 10 min. | 48 | Yes | 0.3 | 2 | 14.8 |
| Example 5: intermediate transfer belt 5 | 21.2 | 145° C., 10 min. | 20 | Yes | 1.2 | 11 | 14.8 |

| | Inner periphery surface resitance (logΩ/□) | Volume resistance (logΩ · cm) | Flake-form image defects (G) | White spots (G) | Endurance | Remarks |
|---|---|---|---|---|---|---|
| Example 1: intermediate transfer belt 1 | 12.0 | 12.4 | G0 | G0 | 1200 kPV OK | Inner peripheral layer and first conductive layer present |
| Example 2: intermediate transfer belt 2 | 9.8 | 12.3 | G1 | G0 | 1200 kPV OK | Inner peripheral layer and first conductive layer present |
| Example 3: intermediate transfer belt 3 | 13.5 | 12.5 | G3 | G0 | 1200 kPV OK | Inner peripheral layer and first conductive layer present |
| Example 4: intermediate transfer belt 4 | 14.6 | 12.6 | G3 | G0 | 1200 kPV OK | Inner peripheral layer and first conductive layer present |
| Example 5: intermediate transfer belt 5 | 12.0 | 13.2 | G0 | G0 | 1200 kPV OK | Inner peripheral layer and first conductive layer present |

As shown in Table 1, neither flake-form image defects nor white spots were observed.

2. Example 2

An electro-conductive belt and an intermediate transfer belt 2 were fabricated in the same manner as in Example 1, except that the drying process for producing the dry film were carried out at a temperature of 145° C. for 40 minutes. The remaining solvent amount in the dry film was 11% by weight. Evaluations of the electro-conductive belt and the intermediate transfer belt 2 were conducted by the same procedures as above. The results are shown in Table 1.

As is shown in Table 1, an innermost layer, a first conductive layer and a second conductive layer were clearly observed in the electro-conductive belt. The thickness of the innermost layer was 1.9 μm and the thickness of the first conductive layer was 15 μm. The surface resistivity of the outer peripheral face of the intermediate transfer belt 2 was 14.4 log Ω/square, the surface resistivity of the inner peripheral face was 9.8 log Ω/square, and the volume resistivity was 12.3 log Ω·cm. From the above results, it was seen that the provided intermediate transfer belt 2 had a high electrical resistance at the outer peripheral face, and an electrical resistance at the inner peripheral face lower than that at the outer peripheral face. Furthermore, neither flake-form image defects nor white spots were observed.

3. Example 3

An electro-conductive belt and an intermediate transfer belt 3 were fabricated in the same manner as in Example 1, except that the drying procedure for producing the dry film were carried out at a temperature of 145° C. for 15 minutes. The remaining solvent amount in the dry film was 40% by weight. Evaluations of the electro-conductive belt and the intermediate transfer belt 3 were conducted by the same procedures as above. The results are shown in Table 1.

As is shown in Table 1, an innermost layer, a first conductive layer and a second conductive layer were clearly observed in the electro-conductive belt. The thickness of the innermost layer was 0.5 μm and the thickness of the first conductive layer was 5 μm. The surface resistivity of the outer peripheral face of the intermediate transfer belt 3 was 14.8 log Ω/square, the surface resistivity of the inner peripheral face was 13.5 log Ω/square, and the volume resistivity was 12.5 log Ω·cm. From the above results, it was seen that the provided intermediate transfer belt 3 had a high electrical resistance at the outer peripheral face, and an electrical resistance at the inner peripheral face lower than that at the outer peripheral face. Flake-form image defects could be observed, but were within a tolerable level. White spots were not observed.

4. Example 4

An electro-conductive belt and an intermediate transfer belt 4 were fabricated in the same manner as in Example 1, except that the drying procedure for producing the dry film was carried out at a temperature of 145° C. for 10 minutes. The remaining solvent amount in the dry film was 48% by weight. Evaluations of the electro-conductive belt and the intermediate transfer belt 4 were conducted by the same procedures as above. The results are shown in Table 1.

As is shown in Table 1, an innermost layer, a first conductive layer and a second conductive layer were faint but were observed in the electro-conductive belt. The thickness of the innermost layer was 0.3 μm and the thickness of the first conductive layer was 2 μm. The surface resistivity of the outer peripheral face of the intermediate transfer belt 4 was 14.8 log Ω/square, the surface resistivity of the inner peripheral face was 14.6 log Ω/square, and the volume resistivity was 12.6 log Ω·cm. From the above results, it was seen that the provided intermediate transfer belt 4 had a high electrical resistance at the outer peripheral face, and an electrical resistance at the inner peripheral face lower, if only by a little, than that at the outer peripheral face. Because the electrical resistance at the inner peripheral face was high, flake-form image defects could be easily observed, but were within a tolerable level. White spots were not observed.

5. Example 5

Electro-conductive belt were manufactured in accordance with the same procedure and conditions as in Example 1, and the outer surface of the obtained electro-conductive belts was abraded and roughened. A primer was applied to the roughened surface, after which a solvent solution of an elastomer, whose resistance value had been adjusted by mixing in carbon black, was applied, and then dried to form a resilient layer at the surface of the electro-conductive belts. Two electro-conductive belts were connected with each other so that the innermost layer was disposed at the inside and an intermediate transfer belt 5 with a peripheral length of 2111 mm was manufactured.

The surface resistivities of the outer peripheral face and the inner peripheral face (log Ω/square) of the intermediate transfer belt 5 and the volume resistivity (log Ω·cm) were measured in accordance with the same procedure as in Example 1. The results were that the surface resistivity of the outer peripheral face was 14.8 log Ω/square, the surface resistivity of the inner peripheral face was 12.0 log Ω/square, and the volume resistivity was 13.2 log Ω·cm. From the above results, it was seen that the provided intermediate transfer belt 5 had a high electrical resistance at the outer peripheral face, and an electrical resistance at the inner peripheral face lower than that at the outer peripheral face.

Flake-form image defect formation and white spot formation were evaluated by the same procedure as in Example 1. As is shown in Table 1, neither flake-form image defects nor white spots were observed.

6. Comparative Example 1

An electro-conductive belt and an intermediate transfer belt 6 were fabricated in the same manner as in Example 1 except that the NMP treatment after preparation of the dry film was not carried out. The electro-conductive belt and the intermediate transfer belt 6 were evaluated by the same procedures as in Example 1. The results are shown in Table 2.

TABLE 2

| | Carbon black (wt. parts) | Drying conditions | Solvent weight (wt %) | Solvent processing | Inner-most layer thickness (μm) | First conductive layer thickness (μm) | Outer periphery surface resistance (logΩ/□) |
|---|---|---|---|---|---|---|---|
| Comparative Example 1: intermediate transfer belt 6 | 21.2 | 145° C., 30 min. | 20 | No | — | — | 15.0 |
| Comparative Example 2: intermediate transfer belt 7 | 26.3 | 145° C., 30 min. | 20 | No | — | — | 11.9 |
| Comparative Example 3: intermediate transfer belt 8 | 21.2 | 145° C., 30 min. | 20 | No | — | — | 13.8 |
| Comparative Example 4: intermediate transfer belt 9 | 21.2 | 145° C., 50 min. | 3 | Yes | — | — | — |

| | Inner periphery surface resitance (logΩ/□) | Volume resistance (logΩ · cm) | Flake-form image defects (G) | White spots (G) | Endurance | Remarks |
|---|---|---|---|---|---|---|
| Comparative Example 1: intermediate transfer belt 6 | 15.0 | 12.3 | G6 | G0 | | No inner peripheral layer or first conductive layer |
| Comparative Example 2: intermediate transfer belt 7 | 11.9 | 8.5 | G0 | G5 | | No inner peripheral layer or first conductive layer |
| Comparative Example 3: intermediate transfer belt 8 | 8.7 | 12.2 | G0 → G6 | G0 | Flake-form surface defects worsened at 200 kPV | No inner peripheral layer or first conductive layer |

TABLE 2-continued

| | | | | | | |
|---|---|---|---|---|---|---|
| Comparative Example 4: intermediate transfer belt 9 | — | — | — | — | — | Air bubbles formed at belt surface by over-drying. Unusable as intermediate transfer belt. |

As shown in Table 2, an innermost layer not containing carbon black and layers with high concentrations of carbon black were not observed in the electro-conductive belt. The surface resistivity of the outer peripheral face of the intermediate transfer belt 6 was 15.0 log Ω/square, the surface resistivity of the inner peripheral face was 15.0 log Ω/square, and the volume resistivity was 12.3 log Ω·cm. From the above results, it was seen that the provided intermediate transfer belt 6 had the same electrical resistance at both the outer peripheral face and the inner peripheral face. Furthermore, obvious occurrence of flake-form image defects was observed. White spots were not observed.

7. Comparative Example 2

An electro-conductive belt and an intermediate transfer belt 7 were fabricated in the same manner as in Comparative Example 1, except that the dispersion amount of carbon black in the dispersion was 26.3 parts by weight, and were evaluated by the same procedures. The results are shown in Table 2.

As is shown in Table 2, an innermost layer not containing carbon black and layers with high concentrations of carbon black were not observed in the electro-conductive belt. The surface resistivity of the outer peripheral face of the intermediate transfer belt 7 was 8.5 log Ω/square, the surface resistivity of the inner peripheral face was 11.9 log Ω/square, and the volume resistivity was 12.3 log Ω·cm. From the above results, it was seen that the provided intermediate transfer belt 7 had the same electrical resistance at both the outer peripheral face and the inner peripheral face. Because the electrical resistance at the inner peripheral face was low, flake-form image defects were not observed, but occurrence of white spots was significant, and it was judged that the occurrence of white spots was greatly exceed a tolerable level.

8. Comparative Example 3

A spray of a dispersion in which graphite was dispersed in isopropyl alcohol (manufactured by NIPPON ACHISON Corporation, product name: Aerodag G) was sprayed on the inner peripheral face of the electro-conductive belt provided in Comparative Example 1, and dried at 25° C. Two electro-conductive belts were connected with each other so that the innermost layer was disposed at the inside, and an intermediate transfer belt 8 was obtained. Evaluation results are shown in Table 2.

The surface resistivity of the outer peripheral face of the intermediate transfer belt 8 was 13.8 log Ω/square, the surface resistivity of the inner peripheral face was 8.7 log Ω/square, and the volume resistivity was 12.3 log Ω·cm. From the above results, it was seen that the provided intermediate transfer belt 8 had a high electrical resistance at the outer peripheral face, and an electrical resistance at the inner peripheral face lower than that at the outer peripheral face. Although no flake-form image defects were observed in the period of evaluation in the practical apparatus, flake-form image defects were easily observed after the application of 200 kPV. White spots were not observed.

9. Comparative Example 4

An electro-conductive belt and an intermediate transfer belt 9 were fabricated in the same manner as in Example 1, except that the drying conditions for producing the dry film were changed into a drying condition of 145° C., 50 minutes. The remaining solvent amount in the dry film was 3% by weight. Because of the over-drying, numerous air bubbles were formed at the surface of the dry film, and it could not be used as an intermediate transfer belt. Therefore, the various evaluations could not be carried out.

Herein, the measurements of electrical resistivity were carried out as follows.

Surface Resistivity

For the measurement, voltage was applied to a ring electrode in conformance with JIS K6911, using a digital ultra-high resistance/micro current meter (manufactured by Advantest Corporation, R8340A), a double electrode UR probe MCP-HTP12 and a registration table UFL MCP-ST03 (both manufactured by DATA INSTRUMENTS Corporation). When carrying out measurement, a test piece was placed on the aforementioned registration table, the aforementioned UR probe was fitted so as to make contact with the measurement surface, and a weight of 2.0±0.1 kg was attached to an upper face of the UR probe and a constant load applied to the test piece. The applied voltage at the time of measurement was 500 V, and the voltage application duration was 10 seconds. Taking the value read by the digital ultra-high resistance/micro current meter as R and the surface resistance correction coefficient of the UR probe MCP-HTP12 as RCF(S), according to DATA INSTRUMENTS Corporation's "resistivity measurement series", RCF(S) is 10.0. Thus, the surface resistivity ρs is given by the following equation (1).

$$\rho s(\log \Omega/\text{square})=\log(R\times RCF(S))=\log(R\times 10.0) \quad \text{Equation (1)}$$

Volume Resistivity

The same measurement instruments were used as for surface resistivity, the same load was applied, and a lower face metal surface served as a voltage application electrode. The applied voltage was 500 V and the voltage application duration was 10 seconds. Taking the test piece thickness as t cm, the value read by the digital ultra-high resistance/micro current meter as R and the surface resistance correction coefficient of the UR probe MCP-HTP12 as RCF(V), according to DATA INSTRUMENTS Corporation's "resistivity measurement series", RCF(V) is 2.011. Thus, the volume resistivity ρv is given by the following equation (2).

$$\rho v(\log \Omega\cdot\text{cm})=\log(R\times RCF(V))=\log(R\times 2.011) \quad \text{Equation (2)}$$

Surface resistivities and volume resistivities were measured in accordance with the above-described measurement methods in a 22° C./55% RH environment. There were a total of 40 measurement points, 4 points in the axial direction and 10 points in the circumferential direction, and average values thereof were taken.

According to an exemplary embodiment of the invention, there is provided an electro-conductive belt having a smaller electrical resistance of an inner peripheral face and a larger electrical resistance of an outer peripheral face and a larger volume resistance.

A second aspect of the present invention relates to the electro-conductive belt of the first aspect, which includes a resin material and conductive particles, the electro-conductive belt including: an innermost layer that contains none of the conductive particles; a first conductive layer that is adjacent to the innermost layer at an outer side thereof, a concentration of the conductive particles being highest in the first conductive layer; and a second conductive layer that is adjacent to the first conductive layer at an outer side thereof, the second conductive layer containing the conductive particles in a concentration lower than in the first conductive layer and higher than in the innermost layer, wherein the average concentration of the conductive particles in the first conductive layer is at least five times higher than the average concentration of the conductive particles in the second conductive layer.

According to the second aspect, there is provided an electro-conductive belt having an electrical resistance of the inner peripheral face smaller than the electrical resistance of the outer peripheral face compared with an electro-conductive belt in which the average concentration of conductive particles in the first conductive layer is less than five times higher than the average concentration of conductive particles in the second conductive layer.

A third aspect of the present invention relates to the electro-conductive belt of the first or second aspect, in which a thickness of the innermost layer is 1.0 to 2 μm.

According to the third aspect, there is provided an electro-conductive belt having a higher uniformity of the innermost layer than an electro-conductive belt having a thickness of the innermost layer lower than 1.0 μm and having no excessive electrical resistance differing from an electro-conductive belt having a thickness of the innermost layer greater than 2 μm.

A fourth aspect of the present invention relates to the electro-conductive belt of the second or third aspect, in which a thickness of the first conductive layer is 10 to 15 μm.

According to the fourth aspect, there is provided an electro-conductive belt having an electrical resistance of the inner peripheral face that is not excessively small, differing from an electro-conductive belt having a thickness of the first conductive layer that is less than 10 μm, the and having an electrical resistance of the inner peripheral face that is not excessively large, differing from an electro-conductive belt having a thickness of the first conductive layer greater than 15 μm.

A fifth aspect of the present invention relates to the electro-conductive belt of one of the first to fourth aspects, there is provided an electro-conductive belt that is used as an intermediate transfer belt to which a toner image formed at a photoconductor surface in an electro-photography-type image forming device is transferred.

According to the fifth aspect, there is provided an electro-conductive belt having an electrical resistance of the inner peripheral face that is not excessively small, differing from an electro-conductive belt having a thickness of the first conductive layer that is less than 10 μm, and having an electrical resistance of the inner peripheral face that is not excessively large, differing from an electro-conductive belt having a thickness of the first conductive layer greater than 15 μm.

A sixth aspect of the present invention relates to an electro-conductive belt fabrication method including: a drying step of forming a dry film, including applying a dispersion, in which conductive particles are dispersed in a solvent solution of a resin material or a precursor thereof, to an inner peripheral face of a circular tube, rotating the circular tube about the axis of the circular tube and forming a dispersion layer at the surface, and simultaneously drying the dispersion layer until an amount of solvent in the dispersion layer reaches a predetermined residual amount; a resin material leaching step including applying a liquid in which the resin material is dissolved or swollen to a surface of the dry film obtained by the drying step, and leaching the resin material to a predetermined depth in the surface of the dry film; and a heating step of heating the dry film into which the resin material has been leached to the predetermined depth by the resin material leaching step and drying the dry film or changing the precursor in the dry film to the predetermined resin material.

According to the sixth aspect, there is provided an electro-conductive belt fabrication method by which an electro-conductive belt having an innermost layer, a first conductive layer and a second conductive layer all of which are formed uniformly along the circumferential direction may be formed with ease.

A seventh aspect of the present invention relates to the electro-conductive belt fabrication method of the sixth aspect, in which the drying step includes drying the dispersion layer such that the residual solvent amount in the dry film is 10 to 20% by weight of the dry film.

According to the seventh aspect, there is provided an electro-conductive belt fabrication method by which an electro-conductive belt having more excellent surface properties than those of an electro-conductive belt wherein drying step is carried out so that the residual solvent amount in the dry film is less than 5% by weight of the dry film, and there is provided an electro-conductive belt a layer with high concentrations of conductive particles and a layer with low concentrations are more clearly separated, and thus, the innermost layer, the first conductive layer and the second conductive layer are more clearly formed compared with an electro-conductive belt having a residual solvent amount in the dry film greater than 40% by weight of the dry film. Here, measurement of a residual solvent amount can be carried out as follows: the total weight of the applied layer before drying is accurately weighed, the solvent amount contained in the total weight of the film is calculated, after performance of the first drying step, the total weight of the film is accurately weighed, an amount of reduction is treated as lost solvent weight, the lost solvent weight is subtracted from the solvent weight calculated for before drying, and then, the residual solvent weight is found. Then, (post-drying film residual solvent weight)/(dry film weight) is calculated to obtain the residual solvent amount.

An eighth aspect of the present invention relates to an image forming device including: a photoconductor at a surface of which an electrostatic latent image is formed; a developing device that develops the electrostatic latent image at the surface of the photoconductor with toner and forms a toner image; an electro-conductive belt according to any of the first to fourth aspects, to which the toner image formed at the surface of the photoconductor is transferred; a secondary transfer portion that transfers the toner image that has been transferred to the electro-conductive belt to a recording medium; and a fixing unit that fixes the toner image that has been transferred to the recording medium.

According to the eighth aspect, an image forming device is provided in which occurrences of white spots and the like are effectively restrained, in comparison with an image forming device that employs as an intermediate transfer belt an electro-conductive belt in which a conductive particle concentration distribution along the thickness direction is uniform.

A ninth aspect of the present invention relates to a transfer unit including: an electro-conductive belt according to one of the first to fifth aspects; and a plurality of rollers on which the electro-conductive belt is extended in a state in which tension is applied, wherein the transfer unit is mountable at an image forming device.

According to the ninth aspect, there is provided a transfer unit wherein occurrences of white spots and the like are effectively restrained, in comparison with a transfer unit that employs as an intermediate transfer belt an electro-conductive belt in which the conductive particle concentration distribution along the thickness direction is uniform.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electro-conductive belt wherein conductive particles are dispersed in a resin material, the electro-conductive belt comprising:

an innermost region having a thickness of from 0.5 to 2 μm and that does not comprise conductive particles;

a first conductive region having a thickness of from 5 to 15 μm and that comprises conductive particles dispersed in the resin material, and is adjacent to the innermost region at an outer side thereof; and a second conductive region that comprises conductive particles dispersed in the resin material; and is adjacent to the first conductive region at an outer side thereof, the second conductive region comprising conductive particles in a concentration lower than a concentration of conductive particles in the first conductive region and higher than a concentration of conductive particles in the innermost region;

wherein the electro-conductive belt is a monolayer electro-conductive belt;

the resin material is a polyimide polymer; and a total thickness of the electro-conductive belt is from 50 to 200 μm.

2. The electro-conductive belt according to claim 1, wherein an average concentration of the conductive particles in the first conductive region is at least five times higher than an average concentration of the conductive particles in the second conductive region.

3. The electro-conductive belt according to claim 1, wherein the thickness of the innermost region is from 1.0 to 2 μm.

4. The electro-conductive belt according to claim 1, wherein the thickness of the first conductive region is from 10 to 15 μm.

5. An intermediate transfer belt to which a toner image formed at a photoconductor surface in an electro-photography-type image forming device is transferred, comprising the electro-conductive belt according to claim 1.

6. An image forming device comprising:

a photoconductor at a surface of which an electrostatic latent image is formed;

a developing device that develops the electrostatic latent image at the surface of the photoconductor with toner and forms a toner image;

an electro-conductive belt according to claim 1, to which the toner image formed at the surface of the photoconductor is transferred;

a secondary transfer portion that transfers the toner image that has been transferred to the electro-conductive belt to a recording medium; and a fixing unit that fixes the toner image that has been transferred to the recording medium.

7. A transfer unit comprising:

an electro-conductive belt according to claim 1; and a plurality of rollers on which the electro-conductive belt is extended in a state in which tension is applied, wherein the transfer unit is mountable at an image forming device.

* * * * *